United States Patent [19]

Franke et al.

[11] Patent Number: 4,681,827

[45] Date of Patent: Jul. 21, 1987

[54] ORGANIC ELECTROPHOTOGRAPHIC MATERIAL SENSITIZED BY CYANINE DYE

[75] Inventors: Werner Franke, Wiesbaden; Richard Brahm, Ingelheim, both of Fed. Rep. of Germany

[73] Assignee: Hoechst Aktiengesellschaft, Frankfurt am Main, Fed. Rep. of Germany

[21] Appl. No.: 852,157

[22] Filed: Apr. 15, 1986

[30] Foreign Application Priority Data

Apr. 17, 1985 [DE] Fed. Rep. of Germany ..... 3513747

[51] Int. Cl.[4] ..... G03G 5/06; G03G 5/09

[52] U.S. Cl. ..... 430/83

[58] Field of Search ..... 430/83, 93

[56] References Cited

U.S. PATENT DOCUMENTS

| | | | |
|---|---|---|---|
| 3,112,197 | 11/1963 | Neugebauer et al. | 96/1 |
| 3,189,447 | 6/1965 | Neugebauer et al. | 96/1 |
| 3,257,203 | 6/1966 | Sues et al. | 96/1.5 |
| 3,458,310 | 7/1969 | Arneth et al. | 96/1.2 |
| 3,660,085 | 5/1972 | Depoorter et al. | 430/93 |
| 3,881,926 | 5/1975 | Ohlschlager et al. | 430/83 X |
| 3,992,205 | 11/1976 | Wiedemann | 96/1.6 |
| 4,063,948 | 12/1977 | Lind | 96/1.6 |
| 4,066,453 | 1/1978 | Lind et al. | 96/1 R |
| 4,153,461 | 5/1979 | Berghaeuser et al. | 96/75 |
| 4,252,880 | 2/1981 | Lind et al. | 430/82 |
| 4,565,757 | 1/1986 | Chalk et al. | 430/83 |

FOREIGN PATENT DOCUMENTS

| | | | |
|---|---|---|---|
| 0106963 | 2/1984 | European Pat. Off. . | |
| 54-121741 | 9/1979 | Japan | 430/83 |
| 354826 | 8/1931 | United Kingdom . | |

OTHER PUBLICATIONS

Reports of the German Chemical Society, vol. 3, (1903) p. 3667.

*Primary Examiner*—Roland E. Martin

*Attorney, Agent, or Firm*—Schwartz, Jeffery, Schwaab, Mack, Blumenthal & Evans

[57] ABSTRACT

An electrophotographic recording material comprising an electrically conductive base material and at least one photoconductive layer containing an organic photoconductor, a binder, and at least one sensitizing dye represented by the formula wherein n denotes 2 or 3 and $X^-$ denotes a monovalent anion. The sensitizing dye has a sensitization maximum between 650 and 840 nm.

13 Claims, 3 Drawing Figures

SENSITIZATION WITH BRILLIANT GREEN------
SENSITIZATION WITH DYE NO. 1 ——

DYE NO. 2
ABSORPTION IN ETHANOL------
SENSITIZATION ——

DYE NO. 1
SENSITIZATION ———
ABSORPTION (ETOH)------

ORGANIC ELECTROPHOTOGRAPHIC MATERIAL SENSITIZED BY CYANINE DYE

BACKGROUND OF THE INVENTION

The present invention relates to an electrophotographic recording material comprising an electrically conductive base material and at least one photoconductive layer containing an organic photoconductor, a binder, and one or more cyanine sensitizing dyes of a specific type, along with customary additives, if any.

In the field of electrophotographic reproduction, photoconductors are used that are radiation-sensitive into the short-wave visible portion of the spectrum. The radiation sensitivity of such photoconductors in the visible portion of the spectrum can be extended by adding one or more sensitizing dyes which are capable of transferring the energy of longer-wavelength light to the photoconductor. Sensitizing dyes from a very wide range of classes of compounds have been used for this purpose.

It is known (German Auslegeschrift No. 2,526,720, corresponding to U.S. Pat. No. 4,063,948) to use for electrophotographic reproduction an electrophotographic recording material that contains in the photoconductive layer a cyanine dye which has a sensitizing action in the blue part of the spectrum. However, such a sensitizing action does not make it possible to utilize the energy from light sources which, like incandescent lamps, have a high red content.

It is alwo known (European Patent Application No. 106,963) to use, as sensitizing dyes in zinc oxide photoconductor layers, special heptamethinecyanines having a betaine structure and a sensitivity within the spectral region between 780 and 840 nm. But these sensitizing dyes do not meet the highest requirements of reproduction. A very specific binder mixture of a styrene/acrylate resin and a vinyl alkanoate resin must also be used in preparing a layer which contains the dyes in question. Even combined with customary organic photoconductors, these sensitizing dyes provide an insufficient sensitizing action.

It is also known (German Offenlegungsschrift No. 1,447,907, corresponding to U.S. Pat. No. 3,458,310) to sensitize photoconductor layers to the visible red wavelengths. This is done, for example, by means of dye mixtures of acridine yellow, acridine orange, rhodamine and brilliant green which are added in one or separately in different layers (German Offenlegungsschrift No. 2,353,639, corresponding to U.S. Pat. No. 3,992,205). The action of the individual dyes being additive or, alternatively, the sensitization which occurs can be different from the summated sensitization spectrum of the individual dyes (German Offenlegungsschrift No. 2,817,428, corresponding to U.S. Pat. No. 4,252,880).

Such panchromatic sensitizations offer advantages, in that light sources with a high red content, which are used in reproduction technology, are utilized more efficiently. In practice, this means shorter exposure times and, hence, time and energy savings. It is possible, not least on accout on the improved sensitivities, to reduce the photoconductor content in the photoconductive layer. The disadvantage with such a continuous sensitization, however, is that the material cannot be processed in physiologically favorable, bright darkroom light.

Many dyes with a powerful sensitizing action in the red spectrum, such as those of the triphenylmethane dye series, effect a very broad sensitization which, nevertheless, has a maximum that generally does not go beyond 700 nm. For that reason, light sources which emit at longer wavelengths cannot be fully utilized, nor is it possible to process the material in bright darkroom light without damaging the material.

SUMMARY OF THE INVENTION

It is therefore an object of the present invention to provide an electrophotographic recording material which is sensitized as far as into the near infrared spectral region by a sensitizer displaying a maximum absorption at a wavelength longer than about 620 nm.

It is also an object of the present invention to provide electrophotographic recording material which is sensitized to light sources emitting in the near infrared region, or in the border area between the visible spectrum and the infrared spectrum, to the extent that the recording material can be processed without damage under a bright darkroom light, for example, in yellow or green light.

In accomplishing the foregoing objects, there has been provided, in accordance with one aspect of the present invention, electrophotographic recording material comprising an electrically conductive base material and at least one photoconductive layer which comprises an organic photoconductor, a binder, and at least one cyanine sensitizing compound represented by the formula

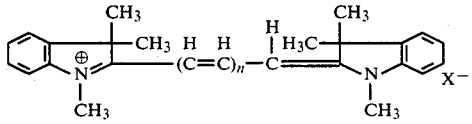

wherein n denotes 2 or 3 and $X^-$ denotes a monovalent anion. In one preferred embodiment, the aforesaid sensitizing compound has a sensitization maximum between 650 and 840 nm.

Other objects features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF PREFERRED EMBODIMENTS

The photoconductive layer of the present invention preferably contains a cyanine dye having a sensitization maximum between 650 and 840 nm. These include, in particular, pentamethinecyanine and heptamethinecyanine.

In silver halide photography it is customary to use cyanine dyes to obtain spectral sensitization of the silver halide, sensitivity-enhancing sensitizers for bright red or infrared being rare. In electrophotography, by contrast, satisfactory sensitizations are virtually impossible to obtain using cyanine dyes. In the context of electrophotography, substantial differences must be recognized between the use of inorganic or organic photoconductors, respectively. It is surprising that the cyanine dyes used in accordance with the present invention produce, in the case of organic photoconductors, a distinctly more powerful and longer-wavelength sensitization than can be obtained, for example, using the triphenylmethane dye "brilliant green," which is known in the electrophotographic industry as a powerful sensitizer in the red.

Figure 1:
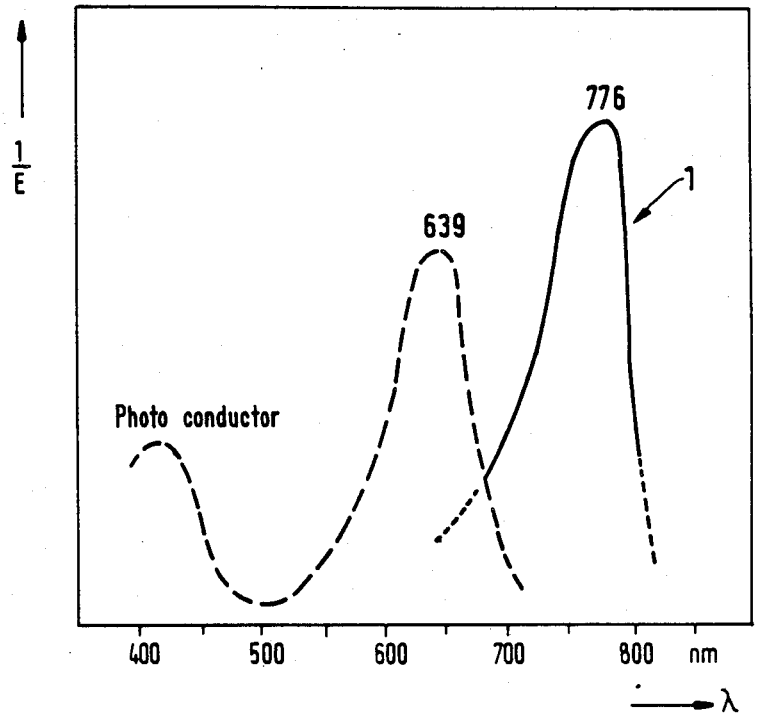
FIG. 1 is a graph depicting the sensitization spectra for the dye brilliant green and a dye used in the present invention, respectively.

This comparison is illustrated in FIG. 1, where the sensitizing action of brilliant green is contrasted with that of the following dye of the present invention:

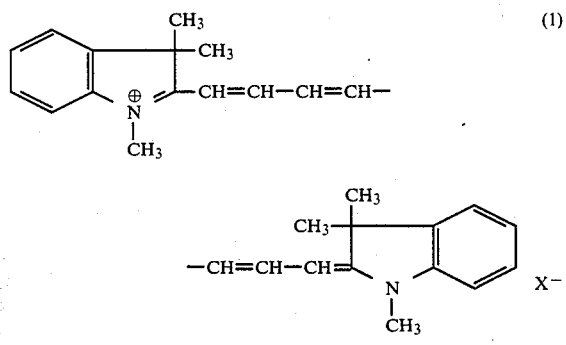

(1)

Figure 2:
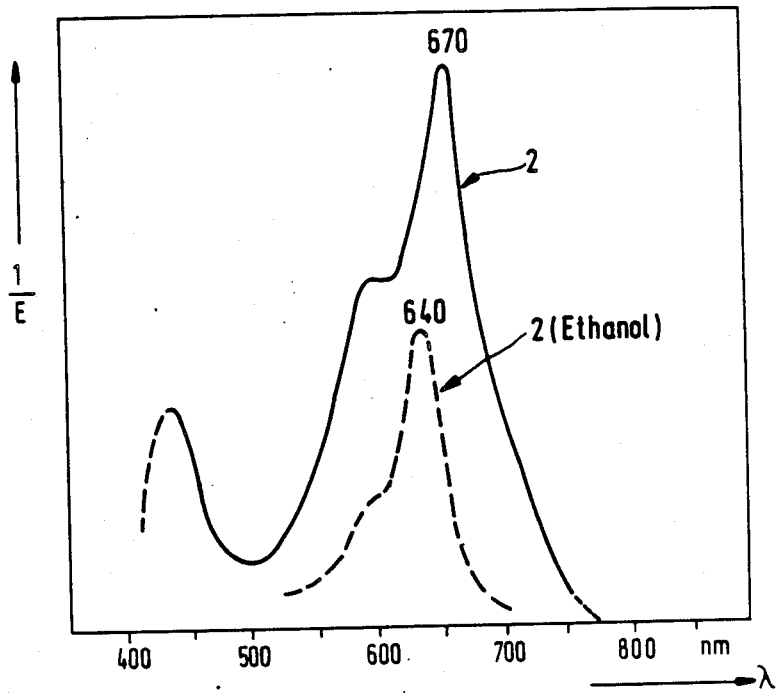
FIGS. 2 and 3 are graphs showing the sensitization spectrograms for two dyes of the present invention and the absorption curves for the same dyes in ethanol.
Figure 3:
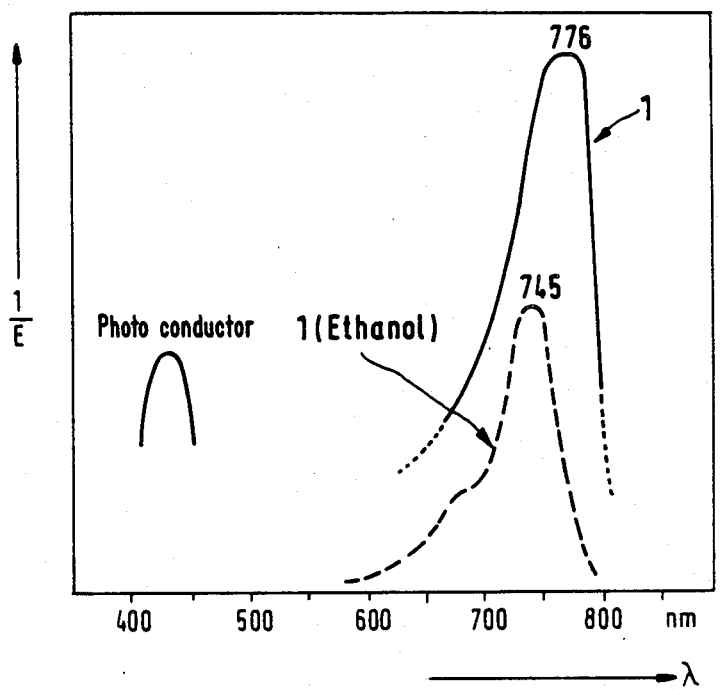

The curve depicted in FIG. 1 represents the sensitization spectrograms obtained by exposure with a high pressure xenon lamp through an interference filter with a linear, stepless grey wedge. The sensitization of the sensitizing dyes is even more clearly shifted toward the longer wavelengths than are their absorption spectra in ethanol, as is shown in FIGS. 2 and 3.

With the sensitization obtained according to the present invention, a recording material can be prepared which is darkroom safe for green and/or yellow light and which has a sensitization with a maximum within the range between 650 and 840 nm. Also, owing to the fact that its sensitization extends into the infrared, the recording material of the present invention permits high utilization of the light from sources, such as III/V LED diodes, lasers and incandescent lamps, which emit primarily or selectively within the near infrared or into the near infrared.

Residual coloring of a photoconductive layer within the present invention is likewise distinctly lower than is achieved when corresponding triphenylmethane dyes are employed.

Because there is a gap in the green-to-yellowish-green region of the sensitization spectrum of recording material within the present invention, it is possible to achieve greater reliability and improved quality, with respect to the manufactured products, through visual control of the work processes, and also to create more pleasant working conditions. This sensitization gap also makes it possible, for example, in the case of printed circuits, to use as the subject copy the mounting of a printed circuit on a layout sheet which has been marked in red. These marks are not reproduced. But at the same time, it is possible with the present invention to work in greenish yellow darkroom light.

The sensitizing dyes according to the present invention are prepared by methods that are customary in the chemistry of sensitizing dyes for silver halide emulsions, and hence are known to those skilled in the art (see A. Claisen, B. 36, 3667 (1903) and British Pat. No. 354,826).

The concentration of the sensitizing dye used in accordance with the present invention depends on the selected photoconductor, on the desired effect, and also on the sensitizing dyes themselves. It is preferable to add about 0.05 to about 3 percent by weight, based on the weight of the photoconductor.

The photoconductive layer of the present invention, incorporating a charge-generating compound and a charge-transporting compound, can be present in single- or a double-layer arrangement. The single-layer arrangement is preferred.

The organic photoconductors used in the present invention are preferably oxazole derivatives, such as 2-vinyl-4-(2'-chlorophenyl)-5-(4'-diethylaminophenyl)-oxazole, as described in German Pat. No. 1,060,260 (corresponding to U.S. Pat. No. 3,112,197) and No. 1,120,875 (corresponding to U.S. Pat. No. 3,257,203), and 2-phenyl-4-(2'-chlorophenyl)-5-(4'-diethylaminophenyl)-oxazole; and oxadiazole derivatives such as 2,5-bis(4'-diethylaminophenyl)-1,3,4-oxadiazole, as described in German Pat. No. 1,058,836 (corresponding to U.S. Pat. No. 3,189,447). Hydrazone and pyrazoline derivatives, such as p-methoxybenzaldehydediphenylhydrazone and 3-methoxyphenyl-1,5-diphenylpyrazoline, are also suitable.

Suitable binders for the present invention are natural and synthetic resins known for their film-forming properties and adhesion. Their selection is determined not only by their film-forming and electrical properties but also, because of the strength of their adhesion to the base material, their solubility properties. For instance, it is possible to use polyester resins, such as copolyesters of isophthalic and terephthalic acid with glycol, or silicone resins, such as three-dimensionally crosslinked phenylmethylsiloxanes, or so-called reactive resins of the type known under the tradename DD-lacquer. Even polycarbonate resins have satisfactory properties for use in the present invention.

Particularly suitable binders for recording material used in the preferred manner according to the present invention, namely, for preparing printing forms, are those that are soluble in aqueous or alcoholic solvent systems, with or without acid or alkali. It is preferable to use alkali-soluble binders. Suitable binders are, therefore, high-molecular substances which carry alkali-solubilizing groups, such as acid anhydride, carboxyl, phenol, sulfo, sulfonamide and sulfonimide groups. Copolymers having anhydride groups can be used particularly successfully since, as a result of the absence of free acid groups, dark conductivity of a photoconductive layer containing such copolymers is low despite high alkali solubility. The preferred alkali-soluble binders include styrene/maleic anhydride copolymers, copolymerization products containing acrylic or methacrylic acid, such as hexyl methacrylate/methacrylic acid/styrene copolymer, and phenolic resin alone or in mixture.

The base materials for recording material within the present invention can be of sheetlike or cylindrical construction, and can consist of a metal plate, a metal foil, metallized papers, or papers or films which have been coated with an electrically conductive plastics material or other conductive inorganic or organic substances.

The base material preferably takes the form of a metal base or a metallized film.

It is possible, following known techniques, to produce toner images on the recording material of the present invention, but it is also possible to transfer either the prepared charge image or the toner image to an image receiving material.

Electrophotographic recording material according to the present invention can contain, as customary additives in the photoconductive layer, levelling agents and plasticizers, and/or adhesion promoters between the base material and photoconductive layer.

The examples below illustrate in more detail, without limiting, the present invention.

EXAMPLE 1

To a solution of 8 g of 2-vinyl-4-(2'-chlorophenyl-5-(4'-diethylaminophenyl)-oxazole and 15 g of a copolymer of styrene and maleic anhydride, in a mixture of 90 g of methylglycol, 140 g of tetrahydrofuran and 40 g of butyl acetate, were added 80 mg of a 1:1 mixture of the sensitizing dye represented by formula 1 and a sensitizing dye represented by formula 2:

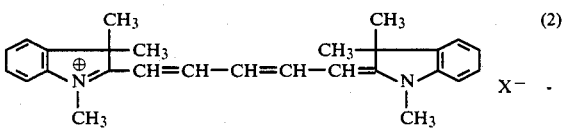

(2)

The solution was applied to an electrochemically roughened and anodized aluminum foil surface which had been pretreated with polyvinylphosphoric acid, as described in German Offenlegungsschrift No. 1,621,478 (corresponding to U.S. Pat. No. 4,153,461). Evaporation of the solvent left a layer which was light-sensitive for greenish yellow into the near infrared at about 850 nm. With the resulting layer it was possible to monitor the work processes visually, even in green light.

From this recording material, a printing form for offset printing was prepared as follows. The photoconductive layer was charged to −430 V in the dark by means of a corona. Exposure was effected over a period of ten seconds with a repro camera set to aperture 14, the light source used being 10 MH lights rated at 600 W each. The resulting latent charge image was developed with a commercially available dry toner by means of a magnetic roll, and the toner image was fixed by heating. After removal of the photoconductive layer in the areas not covered with toner, using a solution containing 50 g of $N_2SiO_3 \times 9\ H_2O$ in 250 g of 86% strength glycerol, diluted with 390 g of ethylene glycol and 310 g of methanol, a planographic printing form was obtained with which a long print run was possible.

EXAMPLE 2

A solution comprising 8 g of 2-phenyl-4-(2'-chlorophenyl)-5-(4'-diethylaminophenyl)-oxazole, 15 g of a copolymer of styrene and maleic anhydride, 140 g of tetrahydrofuran, 40 g of butyl acetate, 90 g of methylglycol, and 40 mg of the sensitizing dye of formula 1 was applied to a vapor-aluminized, 100 μm-thick polyester film. Evaporation of the solvent left behind a photoconductive layer, approximately 5 μm in thickness, which had a spectral sensitivity ranging from the red area of the spectrum to about 830 nm and which had a sensitization maximum at about 780 nm.

The layer was charged up with a corona to about −450 V and was exposed over a 250-second period in a repro camera by means of 8 automatic photolights of 500 watt each. The subject copy used was the mounting of a printed circuit on a layout sheet which had been marked with red marks and orientation lines. Due to the light sensitivity of the photoconductor layer in this spectral region, the markings on the copied sheet were not reproduced.

After development with an electrophotographic liquid developer and removal of the photoconductor layer in the non-image areas using the process described in German Pat. No. 2,322,047 (corresponding to U.S. Pat. No. 4,066,453), the uncovered vapor-aluminized layer was removed by treatment with 2N sodium hydroxide solution. In this manner, a printed circuit was obtained.

EXAMPLE 3

To a solution of 75 mg of the formula 1 sensitizing dye in 90 g of a solvent mixture comprising 140 g of tetrahydrofuran, 40 g of butyl acetate and 90 g of methylglycol, 7.5 g of a copolymer of styrene and maleic anhydride (SCRIPSET® 540, manufactured by Monsanto, Corp., St. Louis) were gradually added with stirring at room temperature, followed by stirring for 15 minutes. 15 g of the photoconductor 2,5-bis-(4'-diethylaminophenyl)-1,3,4-oxadiazole were then added. The coating solution was thereafter whirled onto a surface-brushed aluminum base to a dry layer weight of about 5 g/m$^2$ and further processed, in a conventional manner, ad described in Example 1. The result obtained was a layer selectively sensitized up to about 850 nm, with a maximum at about 780 nm. The material could be processed in green darkroom light.

EXAMPLE 4

Demonstration of the universal applicability of the dye systems of the present invention for sensitizing various organic photoconductors combined with different binders.

To prepare the photoconductor layers, in each case 50 parts by weight of one of the polymeric binders named in the table below are dissolved together with 50 parts by weight of an organic photosemiconductor in 600 parts by weight of tetrahydrofuran, and a methanolic solution of the sensitizing dye was added such that its proportion accounted for 0.5%, based on the total solids.

The solutions were cast onto brushed aluminum sheets, so that drying left layers having a dry weight of about 6 g/m$^2$. To determine the sensitizing action of the dye, the photoconductor layers are charged up negative in the dark under a corona and were exposed through a spectral filter.

The quantities measured were the charge level ($U_o$) and half-value energy ($E_{\frac{1}{2}}$), i.e., the energy which discharges the photoconductor layer to half the initial charge.

The results are compiled in the following table:

| No. | Photoconductor | Binder | Dye No. | $U_o$ (V) | $E_{\frac{1}{2}}$ 660 | 760 | 820 nm |
|---|---|---|---|---|---|---|---|
| a | 2-Phenyl-4-(2'-chlorophenyl)-5-(4-diethylaminophenyl)-oxazole | Copolymer of styrene and maleic anhydride | 1 | −722 | | 13.2 | 9.1 |
| b | 2,5-Bis-(4'-diethylaminophenyl)-1,3,4-oxadiazole | (as for a) | 1 | −904 | | 12.2 | |
| c | 3-Methoxyphenyl-1,5-diphenyl-pyrazoline | (as for a) | 1 | −805 | | 20.7 | |
| d | (as a) | Copolymer of 60 pbw of hexyl methacrylate 30 pbw of methacrylic acid 10 pbw of styrene | 1 | −928 | | 23.5 | |
| e | 2-Vinyl-4-(2'-chlorophenyl)-5-(4'-diethylaminophenyl)-oxazole | (as for a) | 2 | −817 | 4.17 | | |
| f | p-Methoxybenzaldehyde-diphenylhydrazone | (as for a) | 2 | −940 | 5.7 | | |

What is claimed is:

1. Electrophotographic recording material comprising an electrically conductive base material and at least one photoconductive layer which comprises (i) an organic photoconductor selected from the group consisting of an oxazole, an oxadiazole, a hydrazone and a pyrazoline compound, (ii) a binder and (iii) at least one cyanine sensitizing compound represented by the formula:

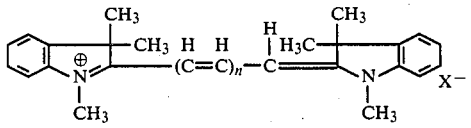

wherein n denotes 2 or 3 and $X^-$ denotes a monovalent anion.

2. Recording material as claimed in claim 1, wherein said sensitizing compound has a sensitization maximum between 650 and 840 nm.

3. Recording material as claimed in claim 1, wherein said sensitizing compound is a pentamethinecyanine dye.

4. Recording material as claimed in claim 1, wherein said sensitizing compound is a heptamethinecyanine dye.

5. Recording material as claimed in claim 1, wherein said photoconductive layer contains a sensitizing dye mixture.

6. Recording material as claimed in claim 1, wherein said organic photoconductor is 2,5-bis-(4'-diethylaminophenyl)-1,3,4-oxadiazole.

7. Recording material as claimed in claim 1, wherein said organic photoconductor is 2-vinyl-4-(2'-chlorophenyl)-5-(4'-diethylaminophenyl)-oxazole.

8. Recording material as claimed in claim 1, wherein said organic photoconductor is 2-phenyl-4-(2'-chlorophenyl)-5-(4'-diethylaminophenyl)-oxazole.

9. Recording material as claimed in claim 1, wherein said organic photoconductor is 3-methoxyphenyl-1,5-diphenyl-pyrazoline.

10. Recording material as claimed in claim 1, wherein said organic photoconductor is p-methoxybenzaldehydediphenyl-hydrazone.

11. Recording material as claimed in claim 1, wherein said base material is a metal base or a metallized film.

12. Recording material as claimed in claim 1, wherein said binder is an alkali-soluble binder.

13. Recording material as claimed in claim 12, wherein said alkali-soluble binder is at least one selected from the group consisting of a styrene-maleic anhydride copolymer, a copolymer containing acrylic or methacrylic acid, and a phenolic resin.

* * * * *